US006868770B2

(12) United States Patent
Cornils

(10) Patent No.: US 6,868,770 B2
(45) Date of Patent: Mar. 22, 2005

(54) AUTOLOADING GAS PORT STRUCTURE

(76) Inventor: Boje Cornils, 5577 Marine St., Russellville, TN (US) 37860

( * ) Notice: Subject to any disclaimer, the term of this patent is extended or adjusted under 35 U.S.C. 154(b) by 0 days.

(21) Appl. No.: 10/448,722

(22) Filed: May 31, 2003

(65) Prior Publication Data

US 2004/0237766 A1 Dec. 2, 2004

(51) Int. Cl.[7] ..... F41A 5/26
(52) U.S. Cl. ..... 89/193; 89/192
(58) Field of Search ..... 89/191.01, 191.02, 89/192, 193

(56) References Cited

U.S. PATENT DOCUMENTS

| | | | | | |
|---|---|---|---|---|---|
| 933,098 | A | * | 9/1909 | McClean | |
| 1,803,523 | A | * | 5/1931 | Conlon | |
| 2,554,618 | A | * | 5/1951 | Dixon | 89/193 |
| 2,783,685 | A | * | 3/1957 | Green | 89/193 |
| 2,983,196 | A | * | 5/1961 | Dixon | |
| 3,333,509 | A | * | 8/1967 | Muhlemann | 89/193 |
| 3,359,860 | A | * | 12/1967 | Muhlemann | 89/193 |
| 3,713,363 | A | * | 1/1973 | Hurlemann | 89/191 |
| 3,893,370 | A | * | 7/1975 | Hutton et al. | 89/191 |

FOREIGN PATENT DOCUMENTS

| | | | | |
|---|---|---|---|---|
| CH | 216186 | * | 8/1941 | 89/193 |
| CH | 365976 | * | 1/1963 | 89/193 |
| FR | 455791 | * | 8/1913 | 89/193 |
| FR | 787074 | * | 2/1936 | 89/191 |
| GB | 461041 | * | 2/1937 | 89/193 |

* cited by examiner

*Primary Examiner*—Stephen M. Johnson

(57) ABSTRACT

A gas porting structure for an autoloading gun, wherein the structure consists of an insert fitting within a slot cut laterally thru the gun barrel and wherein one or more slot like gas ports are formed thru the insert in a longitudinal direction generally axial of the barrel.

6 Claims, 2 Drawing Sheets

AUTOLOADING GAS PORT STRUCTURE

BACKGROUND OF THE INVENTION

1. Field

This invention concerns unique structure for the gas exit port in the barrel of autoloading shotguns or the like, which port exits the high pressure firing gas into the gas cylinder of the spent shell ejection system. Such gun structure is shown and described in detail in U.S. Pat. Nos. 4,693,170; 4,487,103; 4,553,469 4,654,993; and 4,893,547, the disclosures of which are hereby incorporated herein by reference in their entireties.

2. Prior Art

The above patents show the conventional gas porting structure which, for example, is designated 68 in the aforesaid U.S. Pat. No. 4,693,170 patent. Such porting is simply a slot or holes drilled thru the barrel from the outside in which leaves burs or sharp edges on the inside of the barrel. These burs and edges will naturally collect shell debris from repeated firings and restrict the proper flow of gases and also clog the gas cylinder of the ejection system and other components of the gun.

SUMMARY OF THE INVENTION

The present invention eliminates such burrs and sharp edges and debris collection by means of providing a gas porting structure comprising a relatively large lateral cut out in the barrel, and porting insert means having an overall exterior configuration conforming substantially to the overall exterior configuration of said cut out and adapted to fit into said cut out with substantial precision, wherein at least one gas port is formed laterally thru said insert means from its exterior surface thru its interior surface, and wherein the interior edge portions of said port are smooth and radiused.

BRIEF DESCRIPTION OF THE DRAWINGS

The invention will be understood further from the following description and drawings wherein the figures are not drawn to scale or proportion and are intended to visually depict the concepts of the present invention, and wherein.

DETAILED DESCRIPTION

Figure 1:
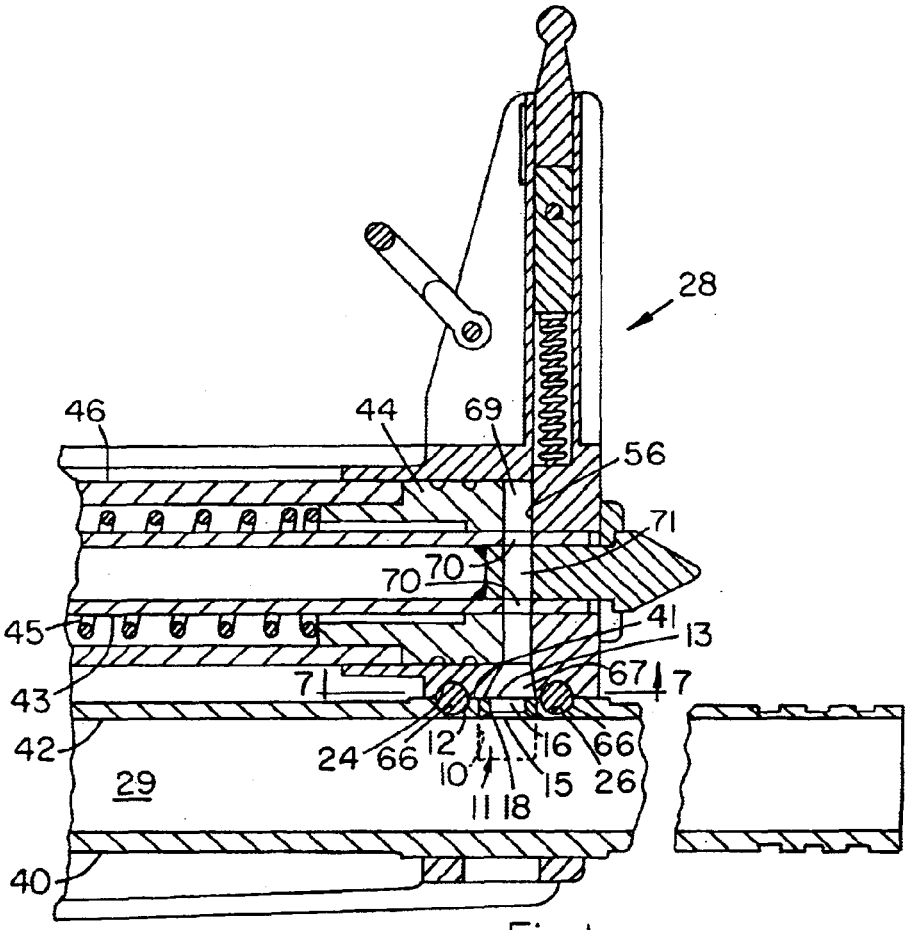
FIG. 1 is a cross sectional view of the gun barrel portion and adjacent gas ejection cylinder construction as shown in FIG. 5 of the aforesaid U.S. Pat. No. 4,693,170 wherein the construction of the gas port 68 of the patent has been modified by means of an insert in accordance with the present invention and wherein the cross-section of the insert is taken along line 6—6 in FIG. 4, i.e., longitudinally thru one of the gas ports thru the insert, with other portions of the insert shown in dotted outline.
Figure 2:
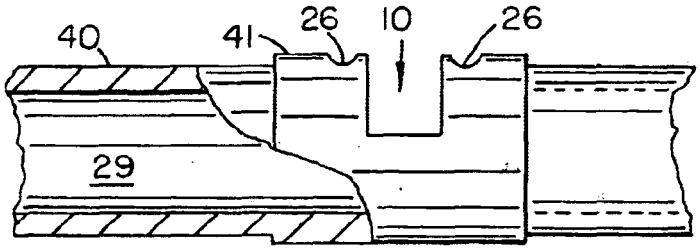
FIG. 2 is a side elevation view of the said barrel portion showing the approximate preferred depth of the cut out for the porting insert.
Figure 3:
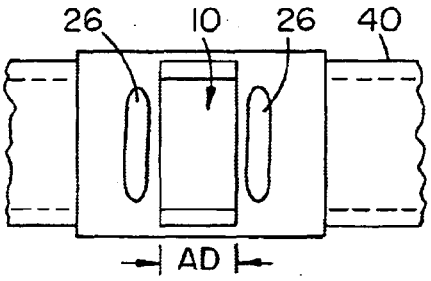
FIG. 3 is a top view of the said barrel portion of FIG. 2.
Figure 4:
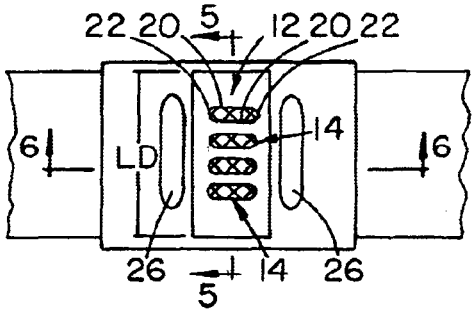
FIG. 4 is a view as in FIG. 3 with the porting insert in place in said cut out.

Referring to the drawings and with particular reference to the claims herein and to the aforesaid patent U.S. Pat. No. 4,693,170, the present invention comprises a cut out generally designated 10 in the barrel 40 entering into the barrel bore 29 into which cut out a gas porting insert generally designated 12 is positioned at close dimensional tolerances, e.g., within about one to about 10 thousandths of an inch. This insert is formed with a lateral dimension "LD" and longitudinal or axial dimension "AD" and a gas porting means having one or more ports 14 wherein, for example for a 12 gauge shotgun, the gas flow area of each port—cross-hatched area—should be such that the total flow or cross-sectional area of all ports combined, preferably is from about 0.05 $in^2$ to about 0.12 $in^2$. The insert structure shown, with four ports, is highly preferred as it affords an adequate gas flow rate while providing good longitudinal or axial, land (16) area on which firing debris such as shell wadding can readily slide on its way out of the barrel. Also, all of the ports are preferably formed along parallel axes a1, a2, a3 and a4.

In further detail and with particular reference to the present claims and amended drawings herein, the present gas porting structure is designed for an autoloading firearm having a cylindrical barrel 40 having an outer cylindrical surface portion 41 and a cylindrical inner (bore) surface 42 and a discharge gas cylinder 69 and piston 44 in gas flow communication with gas porting means 11 provided thru the wall of said barrel and communicating directly with the bore 29 thereof. Piston 44 is affixed to a bolt carrier assembly 148 having a shell extractor means 159, whereby flow of discharge gas into said cylinder 60 will force said piston 44 rearwardly to retract the bolt carrier assembly 148, actuate the shell extractor means 159 and eject a shell 244. The porting means generally designated 11 comprises a lateral cut out 10 completely thru a wall section of said barrel and gas porting insert means 12 positioned in said cut out, wherein said insert means has an outer surface 13 and an inner surface 15 formed on concentric radii 17 and 19 respectively. These radii 17 and 19 are the same (as close as possible) as outer radius 21 and bore radius 23 respectively of barrel 40. Insert means 12 has the same length, thickness and width as said cut out and is fitted into said cut out with substantial precision whereby said inner surface 15 becomes a section of barrel bore 29, wherein at least one gas port 14 is formed thru said insert means and wherein edge portions of said inner surface which outline said at least one gas port are curved such as to eliminate any sharp edge portions on which firing debris could be snagged.

The present method of providing a firearm barrel is unique as evident from the specification and drawings herein and as evidenced by the state of the art.

In the manufacture of the present insert the inside edges 18 of the ports, both of the sides 20 and ends 22 of the ports, are radiused and deburred by any suitable means such as machining, sand blasting or grinding or the like. This deburring is readily done on the present filly accessible insert but would be very difficult, expensive and impractical to perform on the barrels of the prior art. The radiused of the port edges, particularly of the end edges, should be large enough to offer little if any resistance to the flow of firing debris thru the barrel.

Figure 5:
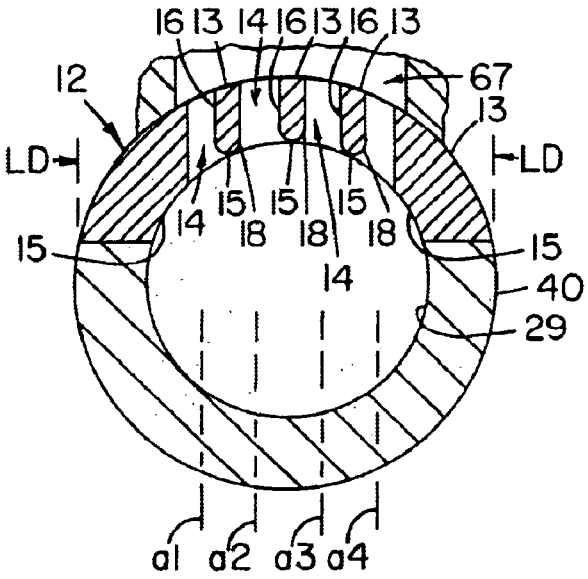
FIG. 5 is a cross-sectional view of the porting insert taken along line 5—5 in FIG. 4 with the port or aperture separators or lands isolated.
Figure 6:
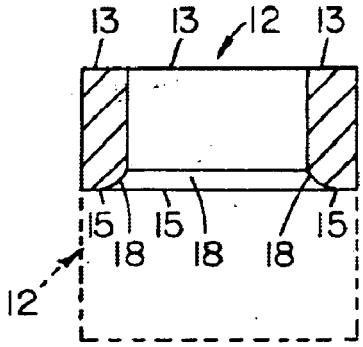
FIG. 6 is a cross-sectional view of said insert taken along line 6—6 in FIG. 4 with other portions of the insert shown in dotted outline.
Figure 7:
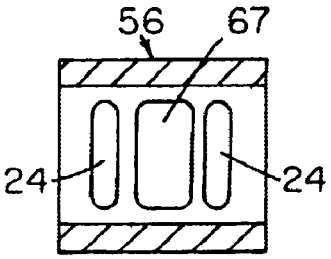
FIG. 7 is a view taken along line 7—7 of FIG. 1 showing portions of the gas collection chamber 67 and adjacent structure.
Figure 8:
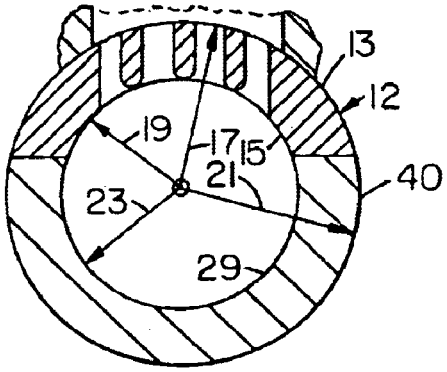
FIG. 8 is a view as in FIG. 5 with the claimed radii denoted.
Figure 9:
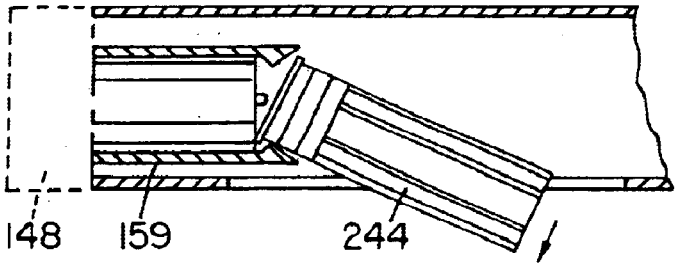
FIG. 9 is a partially schematic and cross-sectioned representation of a bolt carrier assembly, shotgun shell and shell extractor means.

Referring to present FIG. 1 and to FIG. 5 of the aforesaid U.S. Pat. No. 4,693,170, the front of the gas operated antirecoil, shell ejection cylinder and the adjacent portions of the present modified barrel are shown and comprises gas cylinder and front sight 28, base 56, pin slots 24 in 56 gas hole 70, 71, gas cylinder 69, gas piston 44, piston rod 46, guide rod 43, action spring 45, barrel 40, pins 66, pin slots 26 in 40, gas collection chamber 67 and the present cut out 10 and insert 12. It is noted that the total flow area thru chamber 67 should approximate the total flow area of ports 14.

The invention has been described in detail with particular reference to preferred embodiments thereof, but it will be understood that variations and modifications will be effected with the spirit and scope of the invention.

I claim:

1. A gas porting structure for an autoloading gun having a cylindrical barrel having an outer cylindrical surface portion and a cylindrical inner bore surface and a discharge gas operated shell ejection means having a discharge gas cylinder and piston in gas flow communication with gas porting means provided thru the wall of said barrel and communicating directly with the bore thereof, wherein said piston is affixed to a bolt carrier assembly having a shell extractor means, whereby flow of discharge gas into said cylinder will force said piston rearwardly to retract the bolt carrier assembly, actuate the shell extractor means and eject a shell, wherein said porting means comprises a lateral cut out completely thru a wall section of said barrel and gas porting insert means positioned in said cut out, said insert means having an outer surface and an inner surface formed on concentric radii and respectively, which radii and are the same as outer radius and bore radius respectively of the barrel said insert means having the same length, thickness and width as said cut out and being fitted into said cut out with substantial precision whereby said inner surface becomes a section of the barrel bore, wherein at least one gas port is formed thru said insert means and wherein edge portions of said inner surface which outline said at least one gas port are curved such as to eliminate any sharp edge portions on which firing debris could be snagged.

2. The porting structure of claim 1 wherein said insert and said cut out each has a lateral dimension and a longitudinal dimension, wherein said lateral dimensions are substantially the same and wherein said longitudinal dimensions are substantially the same, whereby a precise sliding fit of said insert means into said cut out is afforded, and wherein from one to four slot-shaped gas ports are formed thru said insert means along said longitudinal dimension.

3. The porting structure of claim 2 wherein said gas ports are all formed on parallel axes.

4. The porting structure of claim 2 wherein four gas ports are provided to give a total gas flow area of from about 0.05 $in^2$ to about 0.12 $in^2$.

5. The porting structure of claim 2 wherein said ports extend in substantially straight lines thru said insert from the outer surface to the inner surface and wherein the total gas flow area of all said ports is from about 0.05 $in^2$ to about 0.12 $in^2$.

6. The porting structure of claim 2 wherein said lateral dimension is less than the outside diameter of said barrel.

* * * * *